US005611679A

United States Patent [19]

Ghosh et al.

[11] Patent Number: 5,611,679

[45] Date of Patent: Mar. 18, 1997

[54] CORROSION-RESISTANT PUMP

[75] Inventors: Syamal K. Ghosh, Rochester; Edward P. Furlani, Lancaster; Paul A. Lysiak, Rochester, all of N.Y.

[73] Assignee: Eastman Kodak Company, Rochester, N.Y.

[21] Appl. No.: 636,079

[22] Filed: Apr. 22, 1996

[51] Int. Cl.[6] ..... F04B 17/00

[52] U.S. Cl. ..... 417/420

[58] Field of Search ..... 417/420

[56] References Cited

U.S. PATENT DOCUMENTS

| | | | |
|---|---|---|---|
| 3,679,189 | 6/1972 | Monroe | 310/46 |
| 3,858,308 | 1/1975 | Peterson | 29/598 |
| 4,429,314 | 1/1984 | Albright | 343/788 |
| 4,613,289 | 9/1986 | Kotera | 417/420 |
| 5,269,664 | 12/1993 | Buse | 417/420 |
| 5,290,589 | 3/1994 | Clough et al. | 427/126.3 |
| 5,297,940 | 3/1994 | Buse | 417/420 |
| 5,332,372 | 7/1994 | Kricker et al. | 417/420 |
| 5,352,517 | 10/1994 | Clough et al. | 428/357 |

*Primary Examiner*—John T. Kwon

*Attorney, Agent, or Firm*—Peyton C. Watkins

[57] ABSTRACT

A corrosion-resistant pump for propelling a fluid therethrough, the pump comprises a first magnet for providing a magnetic field. A motor is attached to the first magnet for rotating the magnet. A container is placed adjacent said first magnet for preventing the fluid contained therein from contacting the motor and the first magnet. A second magnet is disposed within the container and magnetically interacting with the first magnet which interaction, in turn, causes the second magnet to rotate simultaneously with rotation of the first magnet. The second magnet is coated with a ceramic magnetic material on its first portion and a bulk ceramic magnet attached to its second portion for preventing corrosion of the magnet and enhancing magnetic flux with the second magnet. A propeller is disposed within the container, and is attached to and simultaneously rotates with the second magnet for propelling the fluid through the container.

7 Claims, 3 Drawing Sheets

CORROSION-RESISTANT PUMP

FIELD OF THE INVENTION

The present invention relates generally to the field of corrosion-resistant, magnetic pumps and, more particularly, to such pumps having a driven magnet with a corrosion-resistant ceramic coating on one portion and with a corrosion-resistant, flux-enhancing bulk ceramic magnet attached to another portion.

BACKGROUND OF THE INVENTION

A corrosion-resistant, magnetic pump typically includes a propeller contained within a fluid containment cavity for permitting a liquid, typically a corrosion-inducing fluid, to be propelled into the pump, through the cavity and then out of the pump. The containment cavity prevents the exposure of the corrosion-inducing fluid to other components of the pump outside the containment cavity for extending the life of the pump.

A motor is positioned outside the containment cavity, and is attached to and rotates a drive magnet for providing a rotating magnetic field which passes through and into the containment cavity for inducing rotation to the propeller. A driven magnet, which is attached to the propeller, is positioned inside the containment cavity for receiving the rotating magnetic flux, in which the magnetic interaction causes the driven magnet to rotate simultaneously with the drive magnet. This, in turn, causes the propeller to rotate for propelling the fluid through the cavity. The drive and driven magnets are typically permanent magnets made of neodymium-iron-boron (NdFeB) or samarium-cobalt (Sm-Co). Therefore, due to the fact that the driven magnet is exposed to the corrosion-inducing fluid, the driven magnet is typically coated with a corrosion-resistant, synthetic resin, such as that disclosed in U.S. Pat. No. 4,613,289, for extending the life of the magnet.

Although the presently known and utilized pump is satisfactory, it is not without drawbacks. The magnetic coupling between the drive and driven magnets is inefficient because they are spaced apart due to the thickness of the wall of the containment cavity. This causes the motor to consume more power to compensate for this inefficiency Consequently, a need exists for improvements in the construction and mode of operation of the pump so as to overcome the above-described drawbacks.

SUMMARY OF THE INVENTION

The present invention is directed to overcoming one or more of the problems set forth above. Briefly summarized, according to one aspect of the present invention, a corrosion resistant pump for propelling a fluid therethrough comprises (a) means for creating a rotating magnetic field; (b) a container, placed adjacent to said magnetic field means, for preventing the fluid contained therein from contacting said magnetic field means; (c) a first magnet disposed within said container and magnetically interacting with said magnetic field means which interaction, in turn, causes the first magnet to rotate simultaneously with rotation of the magnetic field from said magnetic field means; wherein said first magnet is coated with a ceramic magnetic material on its first portion and is attached to a bulk ceramic magnet on its second portion for reducing corrosion of the magnet and enhancing magnetic coupling with the magnetic field means; and (e) a propeller disposed within said container and attached to and simultaneously rotating with said first magnet for propelling the fluid through said container.

It is an object of the present invention to provide a pump having improved interaction of the magnetic flux between the drive and driven magnets.

It is also an object of present invention to provide the driven magnet coated with a ceramic-based ferrite material for extending its life.

It is a feature of the present invention to provide the driven magnet with a thin coating of ceramic-based ferrite material on its first portion and a bulk ceramic magnet attached to its second portion for reducing corrosion of the magnet and for enhancing transfer of the magnetic flux from the drive magnet The above and other objects of the present invention will become more apparent when taken in conjunction with the following description and drawings wherein identical reference numerals have been used, where possible, to designate identical elements that are common to the figures.

DETAILED DESCRIPTION OF THE INVENTION

Figure 1:
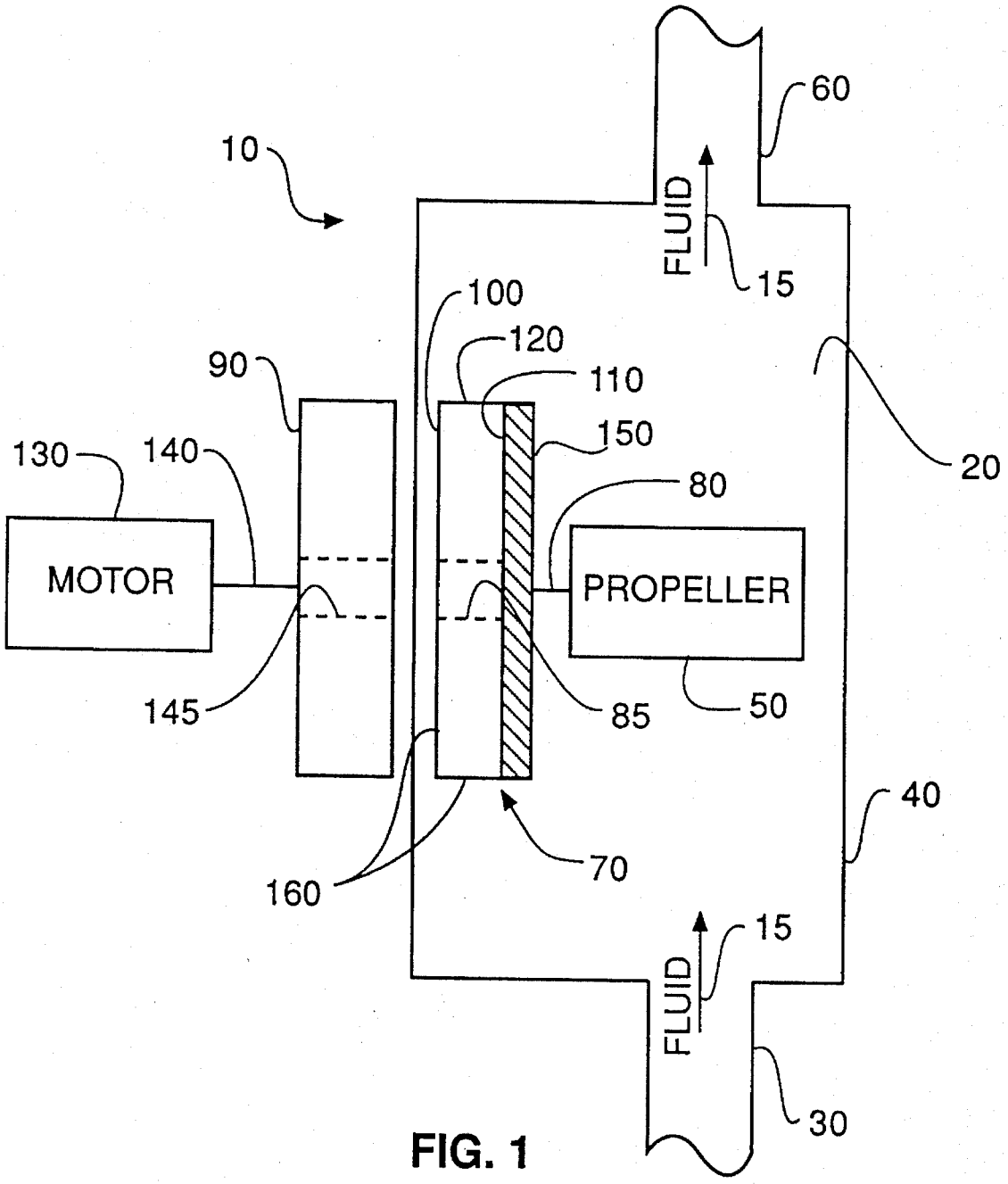
FIG. 1 is a schematic diagram of a pump of the present invention having its drive and driven magnets positioned in a configuration well known in the art as an axial design.

Referring to FIG. 1, there is illustrated an axially designed, corrosion-resistant magnetic pump 10 for propelling a fluid 15, typically a corrosion-inducing fluid, therethrough. The pump 10 includes a containment cavity 20 having an inlet 30 for receiving the fluid 15, a body 40 containing a propeller 50 for propelling the fluid 15, and an outlet 60 for passing the propelled fluid 15 out of the pump 10. The containment cavity 20, in its most germane function to the present invention, prevents the fluid 15 from contaminating other components with its corrosive-inducing agents. A cylindrical-shaped driven magnet 70, which receives a rotating flux from a cylindrical-shaped drive magnet 90, is attached to the propeller 50 via an axle 80 and a ceramic magnet 150, such as manganese-zinc-ferrite, nickel-zinc-ferrite or a combination of the two, (described in detail below). The axle 80 is received by a bore 85 of the driven magnet 70 for attaching the two together. The driven magnet 70 includes a proximal surface 100 that is adjacent the body 40 on one end and a distal surface 110 on its other end, and a side surface 120 between the two.

A motor 130 is attached to the drive magnet 90 via an axle 140 for rotating the drive magnet 90 which, in turn, creates a rotating magnetic field when the drive magnet 90 is rotating. The axle 140 is received by a bore 145 of the drive magnet 90 for attaching the two together. As may be obvious, when the drive magnet 90 is stationary, the flux from the drive magnet 90 is also stationary. The driven magnet 70 receives this flux, and rotates when the flux from the drive magnet 90 is rotating or is stationary when the flux from the drive magnet is stationary. The drive and driven magnets 90 and 70 have a plurality of poles for inducing a torque between them which, in turn, is transmitted to the propeller 50 for causing its blades (not shown) to rotate.

The bulk ceramic magnet 150, such as a magnet made of manganese-zinc-ferrite, nickel-zinc-ferrite or a combination of the two, is integrally attached to the distal surface 110 of the driven magnet 70 by any suitable means such as a liquid-resistant epoxy (not shown). The ceramic magnet 150 enhances the magnetic coupling between the driven magnet 70 and the drive magnet 90. A ceramic coating 160, also comprised of magnesium-zinc-ferrite, nickel-zinc-ferrite or a combination of the two, is placed on the proximal 100 and side 120 surfaces of the driven magnet 70 by thermal spraying either of the above-described powders thereon. Thermal spraying is well known in the art.

Figure 2:
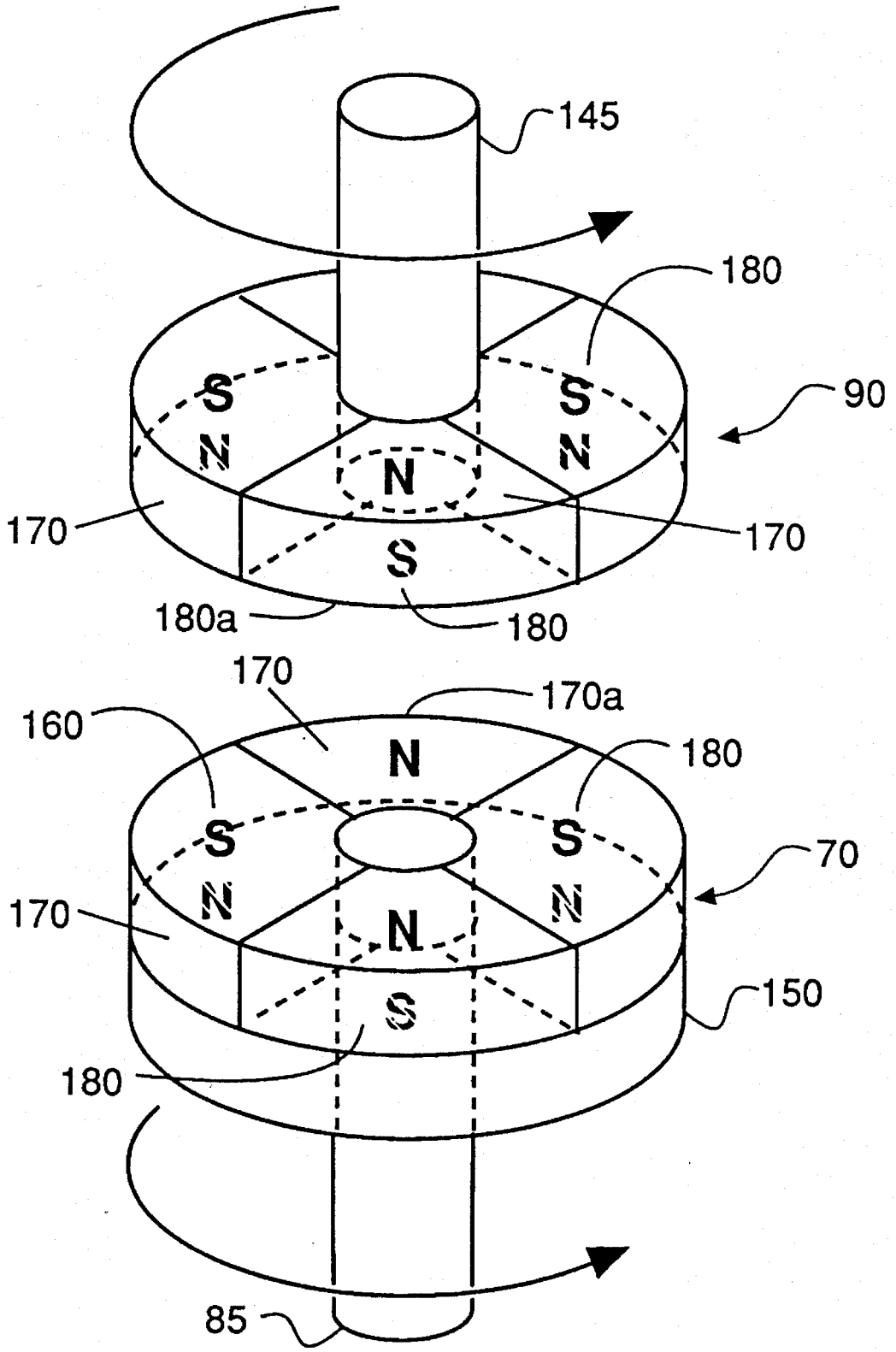
FIG. 2 is a perspective view of the drive magnet and driven magnets of FIG. 1.

Referring to FIG. 2, the drive 90 and driven 70 magnets are illustrated in detail. Each magnet 70 and 90 includes a plurality of north 170 and south 180 poles that are positioned so that the poles from one magnet attract the pole directly opposite it (i.e., north pole opposite a south pole). For example, a south pole 180*a* of the drive magnet 90 is placed directly opposite a north pole 170*a* of the driven magnet 70. The ceramic coating 160 is preferably limited to a minimum thickness of 0.001 inches but not to exceed 0.010 inches for reducing the corrosive action of the fluid while optimally maintaining the magnetic attraction between the two magnets 70 and 90. As indicated by the arrows, the rotating flux from the drive magnet 90 simultaneously causes the driven magnet 70 to rotate. The ceramic magnet 150, as previously stated, is integrally attached to the driven magnet 70 for enhancing the magnetic coupling between the drive and driven magnets 90 and 70.

Figure 3:
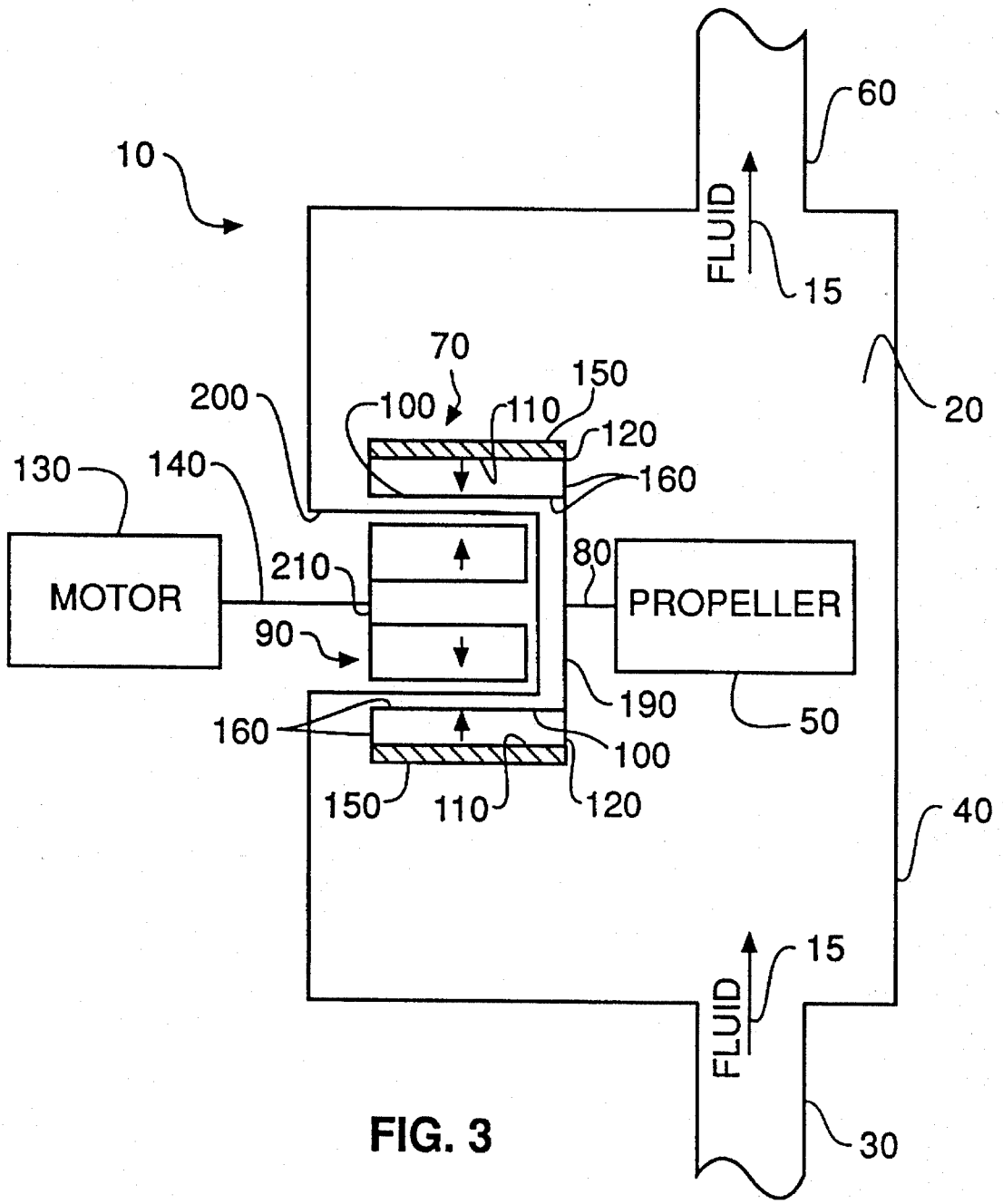
FIG. 3 is an alternative embodiment of FIG. 1 illustrating a schematic diagram of a radially designed pump of the present invention.

While the above-described apparatus is illustrated on an axially designed pump, it is also applicable to a radially designed pump. Referring to FIG. 3, an axially designed pump 10 includes an annular-shaped driven magnet 70 having the ceramic magnet 150 integrally attached to its distal surface 110 and the ceramic-based ferrite material 160 coated onto its proximal 100 and side surfaces 120. The driven magnet 70 includes a connecting surface 190 at one longitudinal end at which the axle 80 is connected to it for transmitting rotation to the propeller 50. An annular-shaped drive magnet 90 is positioned within an indentation 200 in the body 40 for providing the rotating magnetic flux. The drive magnet 90 also includes a connecting surface 210 at one longitudinal end at which the axle 140 is connected to it for transmitting the rotation from the motor 130 to the drive magnet 90.

The invention has been described with reference to a preferred embodiment. However, it will be appreciated that variations and modifications can be effected by a person of ordinary skill in the art without departing from the scope of the invention.

| Parts List: | |
|---|---|
| 10 | pump |
| 15 | fluid |
| 20 | cavity |
| 30 | inlet |
| 40 | body |
| 50 | propeller |
| 60 | outlet |

-continued

| Parts List: | |
|---|---|
| 70 | driven magnet |
| 80 | axle |
| 85 | bore |
| 90 | drive magnet |
| 100 | proximal surface |
| 110 | distal surface |
| 120 | side surface |
| 130 | motor |
| 140 | axle |
| 145 | bore |
| 150 | ceramic magnet |
| 160 | ceramic-based ferrite coating |
| 170 | north pole |
| 170a | north pole |
| 180 | south pole |
| 180a | south pole |
| 190 | connecting surface |
| 200 | indentation |
| 210 | connecting surface |

We claim:

1. A corrosion-resistant pump for propelling a fluid therethrough, the pump comprising:

(a) means for creating a rotating magnetic field;

(b) a container, placed adjacent said magnetic field means, for preventing the fluid contained therein from contacting said magnetic field means;

(c) a first magnet disposed within said container and magnetically interacting with said magnetic field means which interaction, in turn, causes said first magnet to rotate simultaneously with rotation of the magnetic field from said magnetic field means;

wherein said first magnet includes a ceramic magnetic coating on its first portion and is attached to a ceramic magnet on its second portion for preventing corrosion of the magnet and enhancing magnetic flux with said magnetic field means; and (d) a propeller disposed within said container and attached to and simultaneously rotating with said first magnet for propelling the fluid through said container.

2. The pump as in claim 1, wherein the ceramic magnetic coating includes a manganese-zinc-ferrite coating, a nickel-zinc-ferrite coating or both of them in combination.

3. The pump as in claim 2, wherein the first portion includes a proximal surface and a side surface.

4. The pump as in claim 3, wherein the proximal and side surfaces are coated to substantially a minimum of 0.001 inches, but not substantially exceeding 0.010 inches.

5. The pump as in claim 4, wherein the magnet is a manganese-zinc-ferrite magnet, nickel-zinc-ferrite magnet or a magnet having both in combination with each other.

6. The pump as in claim 5, wherein said magnetic field means includes a second magnet for providing the magnetic field.

7. The pump as in claim 6, wherein said magnetic field means includes a motor attached to said second magnet for rotating said second magnet for providing rotation of the magnetic field.

* * * * *